US005165808A

United States Patent [19]

Andou et al.

[11] Patent Number: 5,165,808

[45] Date of Patent: Nov. 24, 1992

[54] WIRE DOT PRINT HEAD

[75] Inventors: Hirokazu Andou; Hiroshi Kikuchi; Tatsuya Koyama; Mitsuru Kishimoto; Kiyoshi Ikeda; Minoru Teshima, all of Tokyo, Japan

[73] Assignee: Oki Electric Industry Co., Ltd., Tokyo, Japan

[21] Appl. No.: 598,644

[22] PCT Filed: Feb. 7, 1990

[86] PCT No.: PCT/JP90/00148

§ 371 Date: Dec. 12, 1990

§ 102(e) Date: Dec. 12, 1990

[87] PCT Pub. No.: WO90/09285

PCT Pub. Date: Aug. 23, 1990

[30] Foreign Application Priority Data

Feb. 16, 1989 [JP] Japan ..... 16279[U]
Mar. 9, 1989 [JP] Japan ..... 26185[U]

[51] Int. Cl.[5] ..... B41J 2/235
[52] U.S. Cl. ..... 400/124; 101/93.05
[58] Field of Search ..... 400/124; 101/93.05

[56] References Cited

U.S. PATENT DOCUMENTS 4,995,744 2/1991 Goldowsky et al. ..... 101/93.05

FOREIGN PATENT DOCUMENTS 83464 11/1980 Japan ..... 400/124
111683 9/1981 Japan ..... 400/124
179759 2/1985 Japan ..... 400/124

*Primary Examiner*—Edgar S. Burr
*Assistant Examiner*—John S. Hilten
*Attorney, Agent, or Firm*—Wenderoth, Lind & Ponack

[57] ABSTRACT

A spring-charged wire dot print head having printing wires is provided with back poles paired up respectively with the cores of electromagnets for cancelling the magnetic flux produced by a permanent magnet, to eliminate the adverse effect of magnetic interference liable to occur in driving the adjacent printing wires. The adjacent pairs of cores and back poles are opposite to each other with respect to the polarity of the magnetic path of the magnetic flux produced by the permanent magnet.

11 Claims, 8 Drawing Sheets

WIRE DOT PRINT HEAD

TECHNICAL FIELD

The present invention relates to a wire dot print head for a printer which drives a plurality of printing wires selectively causing the printing wires to impinge through an ink ribbon against a recording sheet for printing.

BACKGROUND ART

A printer incorporating a conventional wire dot print head has been used widely due to its advantages, which include a high option among various recording media and the capability of using it with copying paper as its recording medium. The wire dot print head drives the wires by the magnetic attraction of permanent magnets or electromagnets.

Recently, the so-called spring-charged wire dot print head has been employed in most printers due to its high response speed.

The spring-charged wire dot print head is provided with armatures, each fixedly holding a printing wire and being supported by a biasing flat spring adapted for swinging motion. The armature is attracted against the resilience of the biasing flat spring to a core by the magnetic attraction of a permanent magnet. In printing, a coil wound around the core is energized to release the armature from the permanent magnet by establishing in the coil a magnetic flux of a polarity reverse to that of the permanent magnet.

In the spring-charged wire dot print head, it is possible that leakage flux among a magnetic flux produced by the electromagnet for cancelling the magnetic flux produced by the permanent magnet causes magnetic interference with, the magnetic flux in the adjacent armature and core, thereby causing change in the magnetic flux in the adjacent armature and core. The effect of magnetic interference on the change of magnetic flux increases with the number of printing wires simultaneously driven for printing, and each coil requires an excitation current greater than that necessary for releasing the corresponding armature from the core when the printing wire is driven individually, thereby increasing the power consumption and rate of heat generation for the printing head.

Since variation in the exciting current affects the action of the released armature, the duration of the supply of current to the coil must be controlled according to the number of printing wires to be driven simultaneously for printing.

The power consumption and heat generation of the spring-charged wire dot print head are further increased by magnetic interference particularly when the spring-charged wire dot print head is miniaturized, formed in a compact construction and operated at a high printing speed.

Many, improvements have been developed to solve such problems. Japanese Patent Laid-open Publication No. 58-96568 discloses a wire dot print head which attempt to account for the magnetic interference by magnetizing the adjacent cores respectively in opposite polarities. This known wire dot print head is shown in FIGS. 1 to 3. FIG. 1 is a sectional view of this known wire dot print head, FIG. 2 is a sectional view taken along the line A—A in FIG. 1, and FIG. 3 is a perspective view of an essential portion of the wire dot print head of FIG. 1.

Referring to FIGS. 1 to 3, a circular bottom frame 11 is formed of a nonmagnetic material, such as aluminum. A plurality of cores 12 having a shape substantially resembling the letter L are placed on the bottom frame 11 in a radial arrangement with their upright portions adjacent the center of the print head. Coils 13 are wound around the upright portions of the cores 12 to form electromagnets 14. Permanent magnets 15 are placed respectively on the rear ends of the cores 12, namely, portions of the cores 12 near the circumference of the print head. The respective polarities of the permanent magnets 15 on the adjacent cores 12 are opposite to each other.

Side yokes 16 are placed respectively on the permanent magnets 15. Flat springs 17 are disposed with their free ends positioned opposite to the corresponding electromagnets 14. Armatures 18 are fastened respectively to the free ends of the flat springs 17. Upper yokes 19 are placed on the flat springs 17. A top frame 20 formed of a nonmagnetic material, such as aluminum, is placed on the upper yokes 19. The top frame 20 is provided integrally with a wire guide 21 in its central portion to hold the tips of printing wires 22 in a predetermined arrangement and to guide the same. The side yokes 16 placed on the permanent magnets 15, the flat springs 17, the upper yokes 19 and the top frame 20 are fastened together with screws 23.

The actions of the dot print head thus constructed will be described hereinafter.

When inoperative, the permanent magnet 14 is not excited and the magnetic flux produced by the permanent magnet 15 passes through the side yoke 16, the upper yoke 19, the armature 18 and the core 12 in that order as indicated by an arrow e. Therefore, the armature 18 is attracted to the core 12 against the resilience of the flat spring 17, so that the flat spring 17 is biased so as to retract the printing wire 22.

In performing a printing operation by selectively driving the printing wires 22, the coil 13 corresponding to the printing wire 22 to be driven for printing is energized. Then, a magnetic flux of a polarity opposite to that of the permanent magnet 15 passed through the armature 17, the upper yoke 19 and the side yoke 16 in that order as indicated by arrows f and g to cancel the magnetic flux indicated by the arrow e, whereby the armature 18 is released from the core 12. Consequently, the printing wire 22 is advanced by the stored energy of the flat spring 17 to print a dot on the recording medium. The printing wires 22 are thus driven selectively to print characters with dot matrices.

The polarity of the magnetic flux indicated by the arrow g is opposite to that of the magnetic flux in the adjacent permanent magnet 15 indicated by an arrow h, and the magnetic flux produced by the electromagnet 14 cancels the magnetic flux produced by the adjacent permanent magnet 15. Therefore, when the adjacent coils 13 are energized simultaneously, the magnetic flux produced by one of the adjacent coils 13 cancels the magnetic flux produced by the permanent magnet 15 corresponding to the other coil 13 and vice versa, and hence the electromagnets 14 can be magnetized satisfactorily by supplying a comparatively small exciting current to the coils 13. Thus, the wire dot print head operates at a comparatively low power consumption rate.

This known wire dot print head, however, places a restriction on the manufacturing process. Since the respective polarities of the adjacent, individual permanent magnets 15 corresponding to the printing wires 22 are opposite to each other, it is impossible to magnetize the permanent magnets 15 simultaneously in a magnetic field of an optional intensity after assembling the wire dot print head. Therefore, the permanent magnets 15, magnetized beforehand in opposite polarities in a desired magnetization intensity, must be arranged individually in assembling the wire dot.,print head through a complicated manufacturing process which is difficult to control. Furthermore, the flat springs 17, the side yokes 16 and the upper yokes 19, in addition to the permanent magnets 15, must be manufactured individually, which increases the cost of the wire dot print head.

Accordingly, it is an object of the present invention to solve the problem inherent in the conventional wire dot print head and to provide a wire dot print head capable of being manufactured by a simple manufacturing process and of operating at a comparatively low power consumption rate.

It is another object of the present invention to provide a wire dot print head capable of stable performance without being affected by different magnetic path configurations.

SUMMARY OF THE INVENTION

The present invention provides a wire dot print head comprising: armatures each provided fixedly at its free end with a printing wire; cores disposed respectively opposite to the armatures; flat springs joined respectively to the armatures and supported in a cantilever fashion; a permanent magnet for magnetically attracting the armatures to the corresponding cores against the resilience of the flat springs; coils wound respectively around the cores to produce a magnetic flux when energized in order to release the armatures from the cores by cancelling the magnetic flux produced by the permanent magnet; a plurality of first core/back pole pairs, each of which comprises a first core mounted atop the permanent magnet and a first back pole not mounted atop the permanent magnet; and a plurality of second core/back pole pairs, each of which comprises a second back pole mounted atop the permanent magnet and a second core not mounted atop the permanent magnet, the plurality of first core/back pole pairs being respectively arranged, in an alternating manner with the plurality of second core/back pole pairs, in a circular arrangement.

Since the wire dot print head of the present invention is provided with only a single permanent magnet and need not be provided with individual permanent magnets, the permanent magnet can be magnetized in a desired magnetization intensity after assembling the wire dot print head by placing the wire dot print head in an intense magnetic field, which simplifies the manufacturing process.

Since the wire dot print head of the present invention is provided with a single permanent magnet, the armatures may be supported on a single flat spring. Furthermore, although the wire dot print head of the present invention needs additional parts, such as the back poles, intermediate yokes and front yokes, which are individual components similar to the individual permanent magnets of the conventional wire dot print head, are omitted to reduce the cost, so that the wire dot print head of the present invention can be manufactured at a reduced cost.

Since each of the second core/back pole pairs has a magnetic path passing, through the back pole and the permanent magnet through the armature in addition to a magnetic path passing through the back pole and the armature, the magnetic flux density in the armature increases to increase the magnetic attraction acting on the armature despite the comparatively long distance between the permanent magnet and the attracting surface of the core. Consequently, the same magnetic attraction acts on the armatures corresponding to both the first and the second core/back pole pairs so that the wire dot print head has stable operating characteristics.

DETAILED DESCRIPTION OF THE INVENTION

Figure 1:
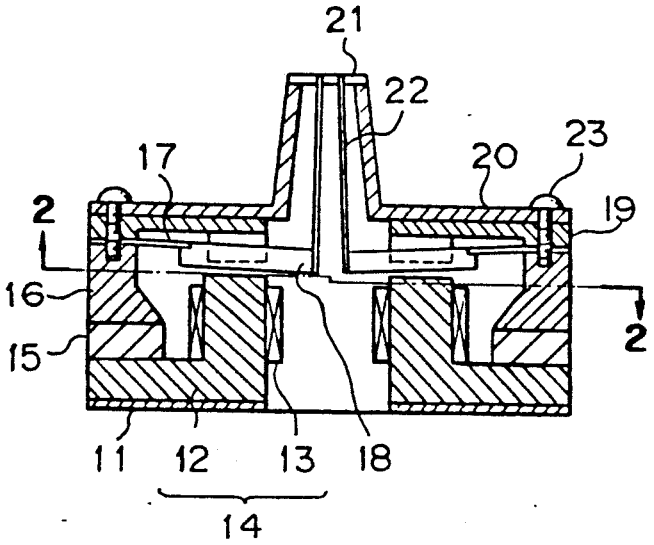
Fig. 1 PRIOR ART
FIG. 1 is a sectional view of a conventional wire dot print head.
Figure 2:
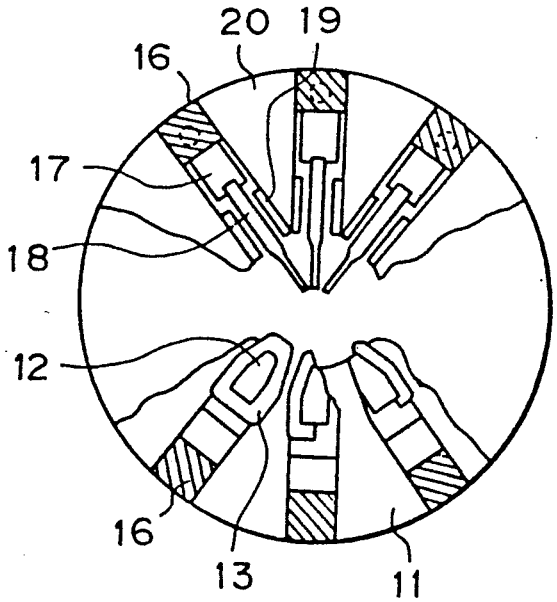
Fig. 2 PRIOR ART
FIG. 2 is a sectional view taken along the line 2—2 in FIG. 1.
Figure 3:
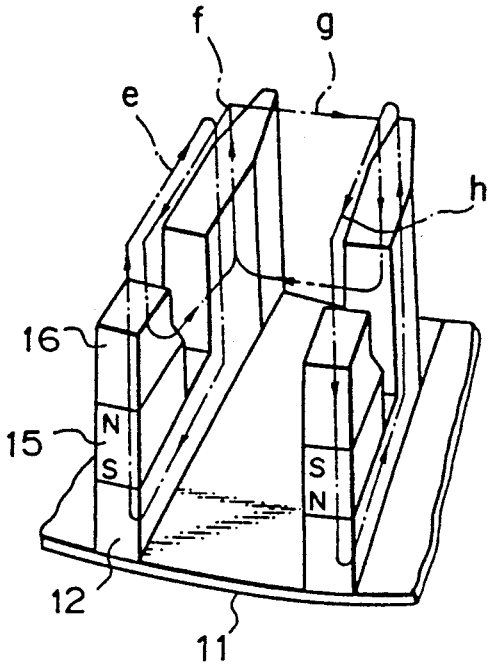
Fig. 3 PRIOR ART
FIG. 3 is a perspective view of an essential portion of the conventional wire dot print head.
Figure 4:
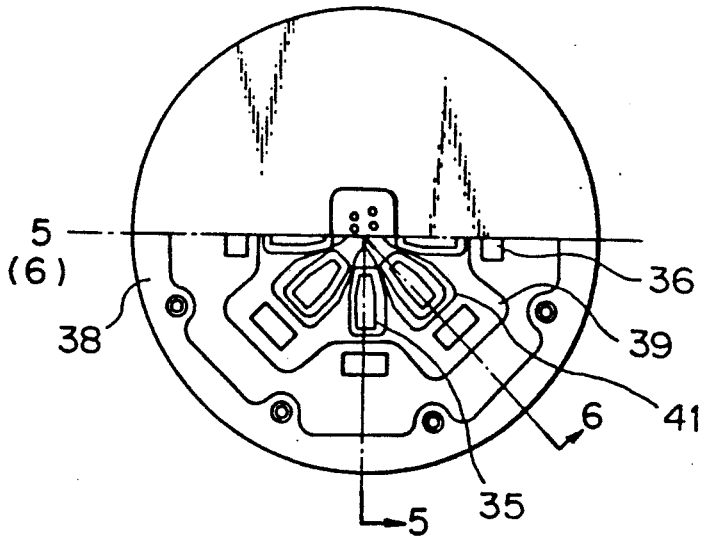
FIG. 4 is a plan view of an essential portion of a wire dot print head in a preferred embodiment according to the present invention.
Figure 5:
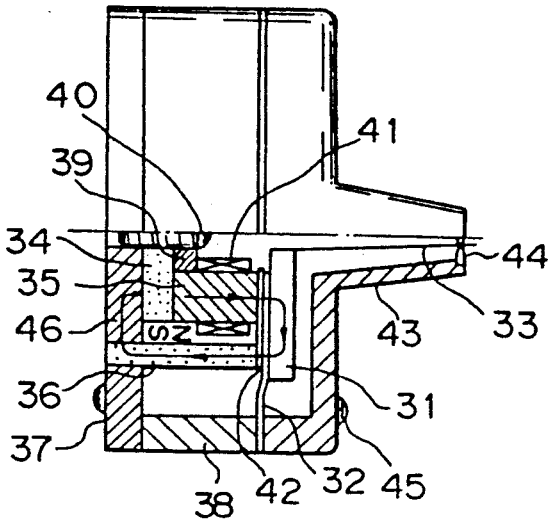
FIG. 5 is a sectional view taken along the the line 5—5 in FIG. 4.
Figure 6:
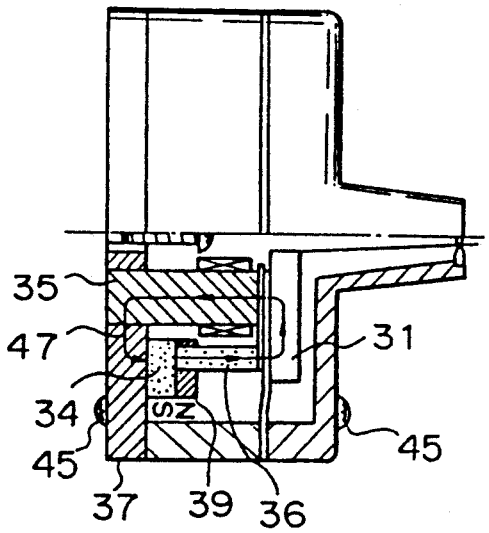
FIG. 6 is a sectional view taken along the line 6—6 in FIG. 4.
Figure 7:
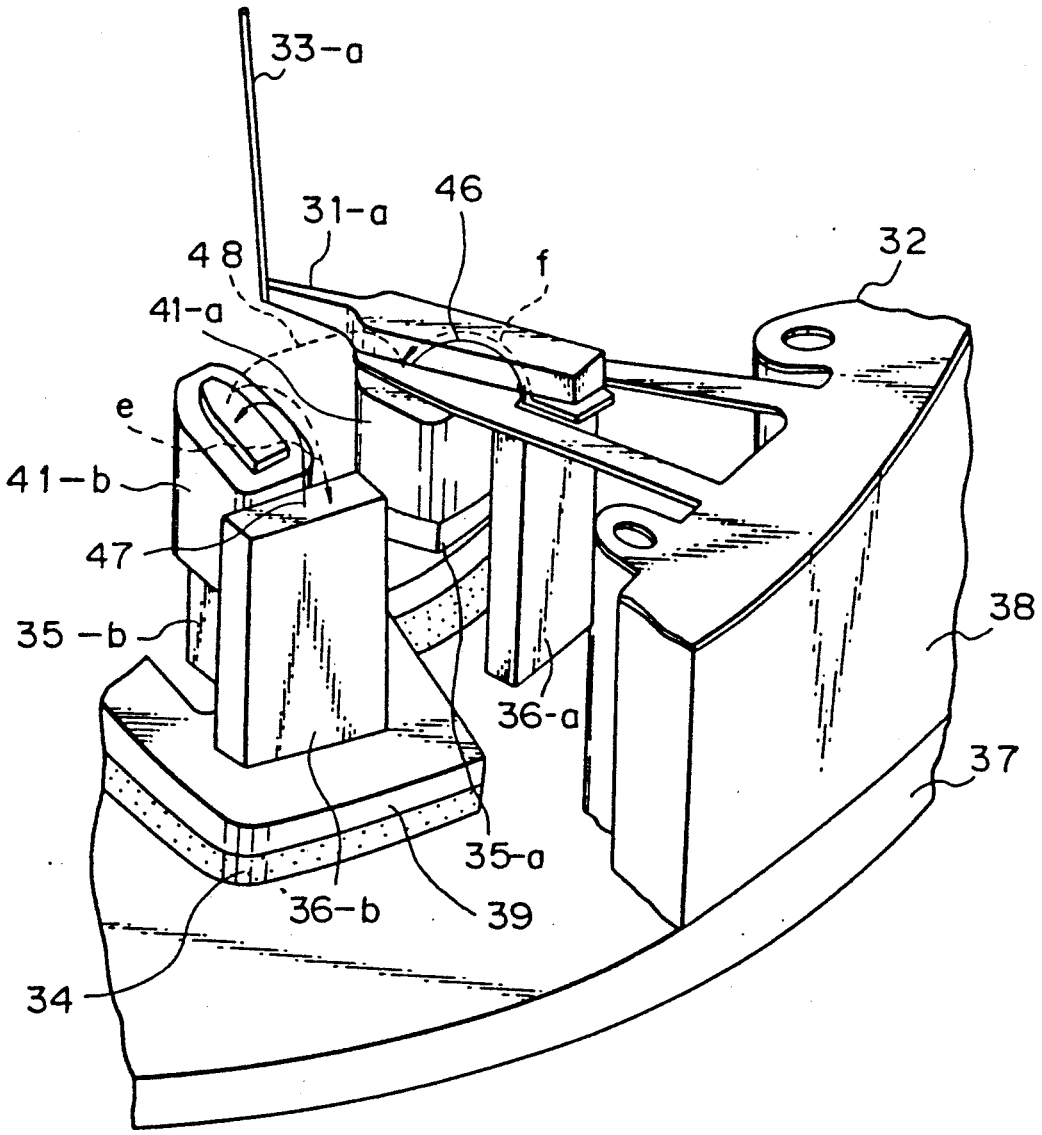
FIG. 7 is a perspective view of an essential portion of the wire dot print head.
Figure 8:
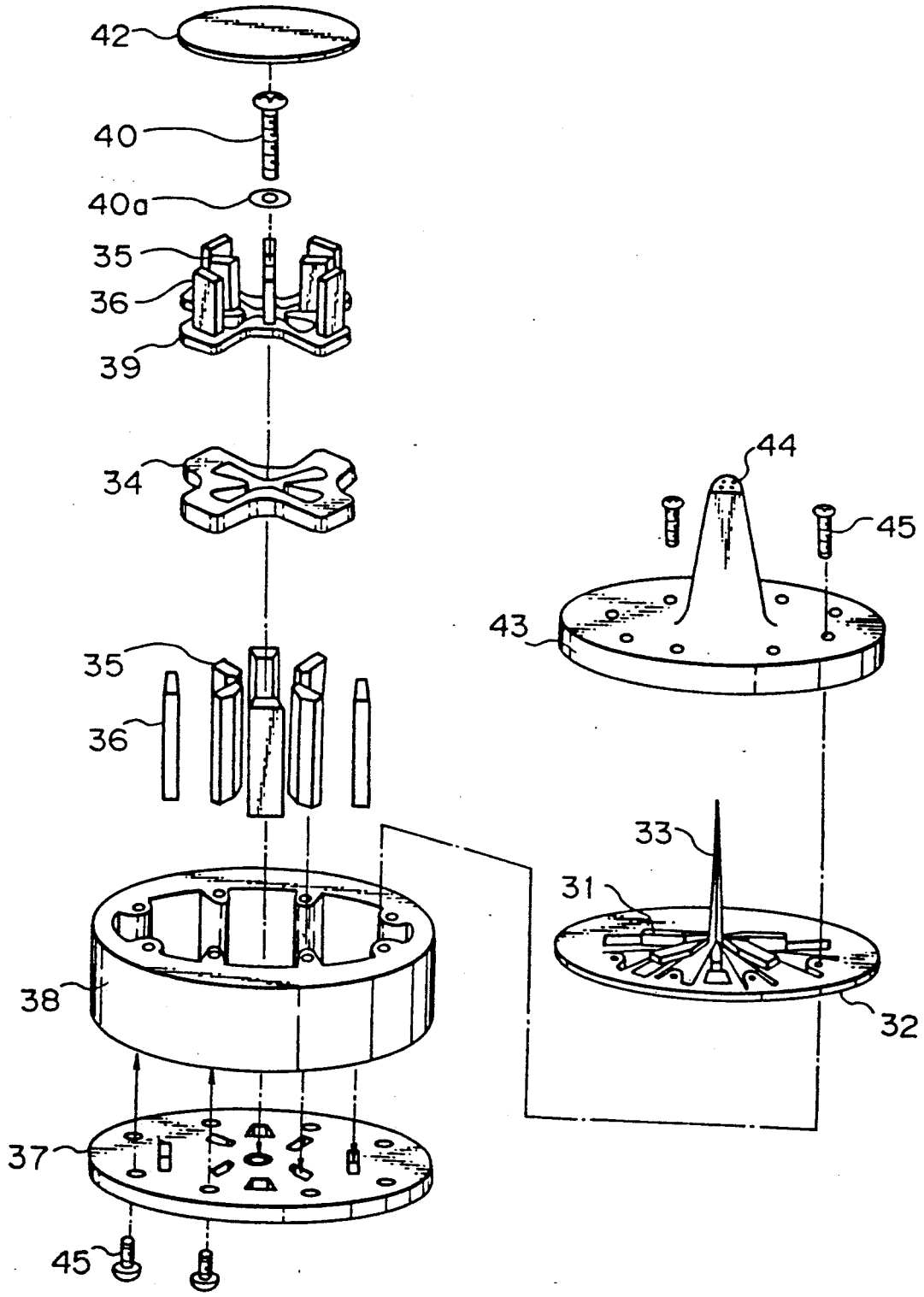
FIG. 8 is an exploded perspective view of the wire dot print head of FIG. 7.

FIG. 4 is a plan view of an essential portion of a wire dot print head in a first embodiment according to the present invention, FIG. 5 is a sectional view taken along the line 5—5 in FIG. 4, FIG. 6 is a sectional view taken along the line 6—6 in FIG. 4, FIG. 7 is a perspective view of an essential portion of the wire dot print head, and FIG. 8 is an exploded perspective view of the wire dot print head.

The wire dot print head has two kinds of cores 35 as shown in FIGS. 5 and 6 alternatingly arranged in a radial arrangement.

Referring to the drawings, there are shown armatures 31 fixedly provided at their extremities with printing wires 33 and fixed respectively to the free ends of projections of a flat spring 32 by, for example, laser welding, a substantially annular permanent magnet 34 magnetized in the direction of its thickness, the magnetic cores 35, magnetic back poles 36, a circular base plate 37 formed of a magnetic material and fixedly supporting the cores 35 and the back poles 36 in an alternating circular arrangement, a spacer ring 38 to which the periphery of the flat spring 32 is fixed, a magnet plate 39 placed on the permanent magnet 34 alternatingly supporting the cores 35 and the back poles 36, and a screw 40 for fastening together the magnet plate 39, the permanent magnet 34 and the base plate 37; Also provided are a washer 40*a*, exciting coils 41 wound respectively around the cores 35, a residual sheet 42 placed between the cores 35 and the flat spring 32 and between the back poles 36 and the flat spring 32 to protect the armatures 31 and the top surfaces of the cores 35, and a head frame 43 fastening the periphery of the flat spring 32 to the spacer ring 38 and holding a wire guide 44 at a correct position. The head frame 43 and the base plate 37 are fastened to the spacer ring 38 with screws 45. The flat spring is held firmly between the top frame 43 and the spacer ring 38.

Holes for receiving the different cores and holes for receiving the different back poles are formed alternatingly in a circular arrangement in the base plate 37. The cores 35 are fixedly fitted in the holes for the cores, and the back poles corresponding to the cores 35 adjacent to the cores 35 fitted in the holes are fixedly fitted in the holes for the back poles.

Holes for receiving the cores and holes for receiving the back poles are formed alternatingly in a circular arrangement in the magnet plate 39. The back poles 36 corresponding to the cores 35 fixed to the base plate 37, and the cores 35 corresponding to the back poles 36 fixed to the base plate 37 are fixedly fitted in the alternate holes for the cores and the back poles.

As clearly shown in FIG. 8, the permanent magnet 34 is formed as a plate having a plurality of radially outwardly projecting extensions and a plurality of radially inwardly extending recesses, as well as a hole formed through a central portion thereof and extending radially outwardly to extend into each of the extensions of the plate of the permanent magnet. With this shape of the permanent magnet 34, the cores 35 and back poles 36 can be arranged in pairs in an alternating manner in a circular arrangement. That is, a plurality of first core/-back pole pairs is defined by a plurality of the cores 35, now designated as the first cores, which are mounted atop the permanent magnet, and a plurality of the back poles, now designated as the first back poles, which are not mounted atop the permanent magnet 34. A plurality of second core/back pole pairs is defined by a plurality of the back poles 36, now designated as second back poles, which are mounted atop the extension of the plate which forms the permanent magnet 34, and a plurality of the cores 35, now designated as second cores, which are not mounted atop the permanent magnet 34, but are rather mounted in the radially outwardly extending portions of the hole formed in the plate of the permanent magnet 34. The plurality of first core/back pole pairs is respectively arranged, in an alternating manner with the plurality of second core/back pole pairs, in a circular arrangement.

The magnet plate 39 and the permanent magnet 34 are the same in shape and are provided with holes and recesses as clearances for the cores 35 and the back poles 36 fixed to the base plate 37. When the permanent magnet 34 and the magnet plate 39 provided with the holes and recesses and fixedly holding the cores 35 and the back poles 36 are fixed coaxially to the base plate 37 with screws 45, the cores 35 are arranged on a circle and the back poles 36 are arranged on another circle. Thus, the wire dot print head has second core/back pole pairs, each consisting of the core 35 fixed to the base plate 37 and the back pole 36 fixed to the permanent magnet 34, and first core/back pole pairs, each consisting of the core fixed to the permanent magnet 34 and the back pole fixed to the base plate 37.

The cores 35 and the back poles 36 provided on the base, plate 37 may be formed integrally with the base plate 37, and the cores 35 and the back poles 36 provided on the magnet plate 39 may be formed integrally with the magnet plate 39.

The flat spring 32 is placed on the spacer ring 38 so that the armatures 31 supported respectively on the free ends of the projections of the flat spring 32 are located opposite to the corresponding cores 35 and the back poles 36. The residual sheet 42 is placed between the projections of the flat spring 32 and the cores 35 and between the projections of the flat spring 32 and the back poles 36. The head frame placed on the periphery of the flat spring 32, and screws 45 passed through the head frame 43, are screwed in the threaded holes of the spacer ring 38 to fasten the flat spring 32 and the head frame 43 to the spacer ring 38. Thus, all the parts are assembled to construct the wire dot print head.

In this state, the tips of the printing wires 33 are held in a predetermined arrangement by the wire guide 44.

Each armature 31 is able to turn on the corresponding back pole 36. The residual sheet 42 protects the upper surfaces of the back poles 36, the flat spring 32, and the upper surfaces of the cores 35. Even if the armatures 31 do not turn on the corresponding back poles 36, the residual sheet 42 protects the contact surfaces.

The operation of the wire dot print head thus constructed will be described hereinafter.

When the wire dot print head is inoperative, a magnetic flux produced by the permanent magnet 34 of the second magnet assembly, in which the permanent magnet 34 is disposed as shown in FIG. 5, is confined to a path 46 consisting of the core 35, the armature 31, the back pole and the base plate 37, whereby the armature 31 is attracted to the core 35 against the resilience of the flat spring 32, thereby straining the flat spring 34 to store energy. On the other hand, a magnetic flux produced by the permanent magnet 34 of the first magnet assembly, in which the permanent magnet 34 is disposed as shown in FIG. 6, is confined to a path 47 consisting of the back pole 36, the armature 31, the core 35 and the base plate 37, whereby the armature 31 is attracted to the core 35.

The polarity of the magnetic flux confined to the path 47 and that of the magnetic flux confined to the path 47 are opposite to each other.

Referring to FIG. 7, in selectively driving the printing wires 33 for printing, the exciting coil 41-*b* corresponding to the selected printing wire 33 is energized to produce a magnetic flux of a polarity indicated by an arrow e opposite to that of the permanent magnet 34 represented by the path 47. Then, some of the magnetic flux produced by the coil 41-*b* passes through the adjacent armature 31-*a* and the adjacent core 35-*a*. Since the polarity of the magnetic flux produced by the coil 41-*b* is opposite to that of the magnetic flux produced by the permanent magnet 34 and passing through the armature 31-*a* and the core 35-*a*, some of the magnetic flux produced by the coil 41-*b* reduces the magnetic flux produced by the permanent magnet 34 and passing through the armature 31-*a* and the core 35-*a*. Therefore, when the adjacent coils 41-*b* and 41-*a* are energized simultaneously, a magnetic flux f, smaller than that to be produced by the coil 41-*a* when only the coil 41-*a* is energized may be produced by the coil 41-*a* for normal printing operation, which reduces the power consumption rate of the wire dot print head.

The wire dot print head employs the cores 35 of two different constructions, which exert different magnetic attractions respectively to the corresponding armatures 31. That is, a magnetic attraction exerted by the magnetic flux confined to the magnetic path shown in FIG. 6 to the corresponding armature 31 is smaller than that exerted by the magnetic flux confined to the magnetic path shown in FIG. 5 to the corresponding armature 31. Thus, the armatures 31 are different from each other in operating characteristics.

The magnitude of the magnetic attraction acting on the armature 31 is dependent on the magnitude of the magnetic flux passing through the core 35 and the armature 31 and that of the magnetic flux passing through the back pole 36 and the armature 31, and is dependent mostly on the former. The magnitude of the magnetic flux is dependent on the characteristics of the permanent magnet, the qualities and reluctances of the components forming the magnetic path, and the leakage flux. As compared with the magnetic path shown in FIG. 6, the magnetic path shown in FIG. 5 has the permanent magnet 34 directly under the core 35, the distance between the permanent magnet 34 and the end surface of the core 35 facing the armature 31 is shorter, nothing having a large reluctance is interposed between the permanent magnet 34 and the core 35, and hence the leakage flux is smaller.

In other words, when the respective coils of the adjacent first and second magnet assemblies are energized simultaneously, the leakage flux of the first magnet assembly passes through the second magnet assembly to enhance the magnetic flux produced by the coil of the second magnet assembly and vice versa. Consequently, the respective inductances of the coils are increased to reduce the currents flowing through the coils. Thus, reduced magnetic fluxes may be produced by the coils for normal printing operation.

The wire dot print head thus constructed employs the permanent magnet 34 formed of a single piece which can be magnetized after assembling the wire dot print head, which reduces the manufacturing cost.

In the magnetic path shown in FIG. 6, the permanent magnet 34 and the core 35 are separated from each other and hence the leakage flux is large. However, since the back pole 36 is placed on the permanent magnet 34 and the distance between the permanent magnet 34 and the end surface of the back pole 36 facing the armature 31 is short, the magnetic flux density in that portion is high, and hence the magnetic path can readily be saturated.

Accordingly, the magnetic flux in the end surface of the core in the magnetic path of FIG. 5 is greater than that in the end surface of the core in the magnetic path of FIG. 6, whereas the attraction acting on the armature 31 at the end surface of the back pole in the magnetic path of FIG. 6 is smaller than that at the end surface of the back pole in the magnetic path of FIG. 5.

A wire dot print head in a second embodiment according to the present invention will be described hereinafter.

Figure 9:
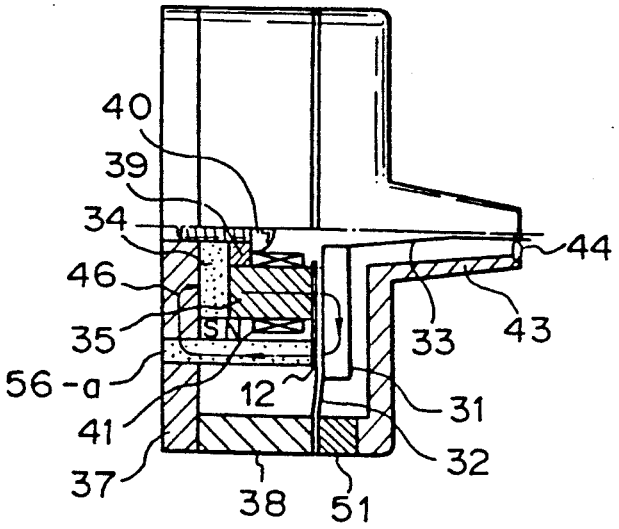
FIG. 9 is a sectional view of an essential portion of a wire dot print head in another embodiment according to the present invention.
Figure 10:
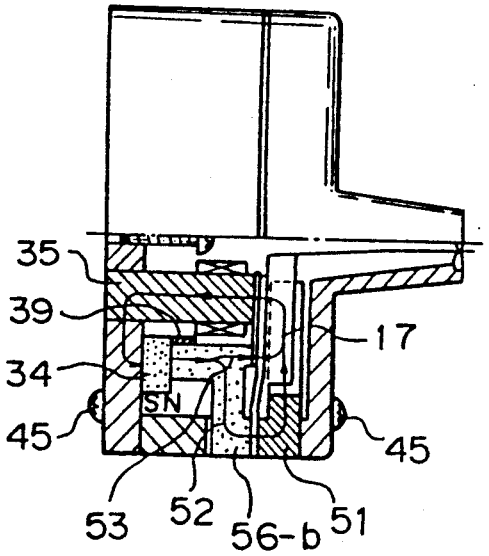
FIG. 10 is a sectional view of another essential portion of the wire dot print head.
Figure 11:
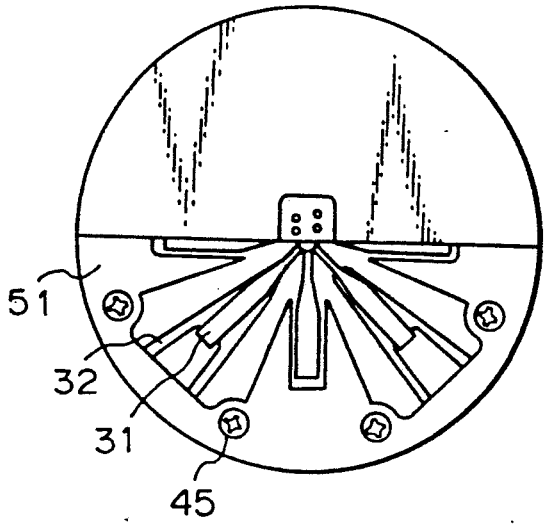
FIG. 11 is a sectional view showing the essential portion of the wire dot print head, in which a head frame is removed.
Figure 12:
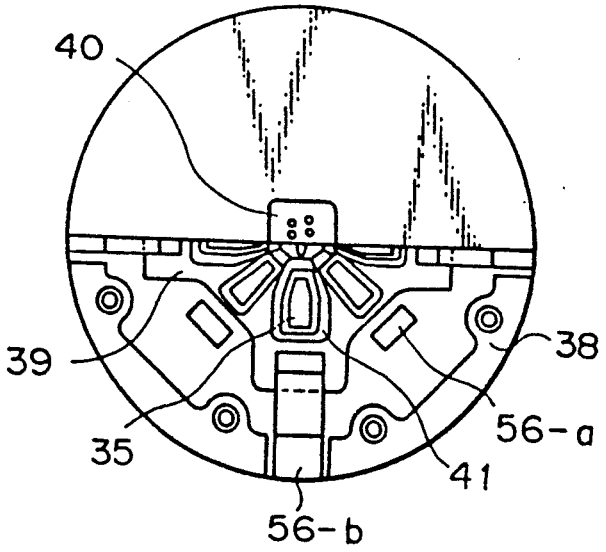
FIG. 12 is a plan view of an essential portion of the wire dot print head, in which armatures, a flat spring and a metallic residual sheet are removed.
Figure 13:
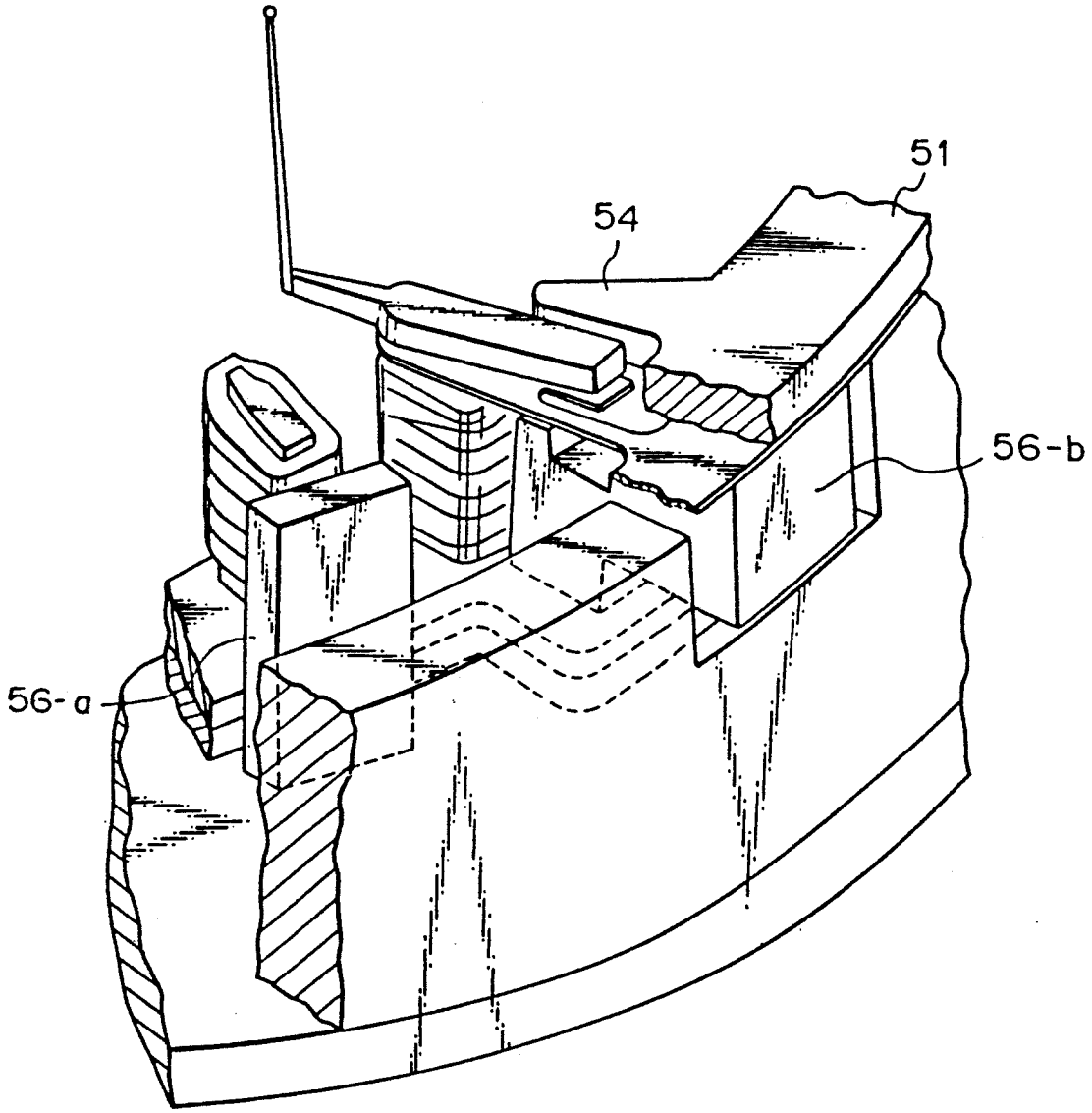
FIG. 13 is a perspective view of an essential portion of the wire dot print head, in which the head frame is removed.

FIG. 9 is a sectional view of an essential portion of the wire dot print head in the second embodiment, FIG. 10 is a sectional view of another essential portion of the same wire dot print head, FIG. 11 is a plan view of an essential portion of the same wire dot print head, in which a head frame is removed, FIG. 12 is a plan view of an essential portion of the same wire dot print head, in which armatures, a flat spring and a metallic residual sheet are removed, and FIG. 13 is a perspective view of an essential portion of the same wire dot print head, in which the head frame is removed.

Referring to FIGS. 9 and 10, the wire dot print head in accordance with the present invention, similarly to the wire dot print head of the first embodiment, is provided with two kinds of cores 35 in an alternatingly arrangement. A plurality of back poles 56-*a* and 56-*b*, which are different from each other in cross section, are arranged alternatingly around the circular arrangement of the plurality of cores 35 so as to be paired up respectively with the cores 35.

The pairs formed by cores 35 and back poles 56-*a* are each provided with a permanent magnet 34 under the core 35, and the pairs formed by cores 35 and back poles 56-*b* are each provided with the permanent magnet 34 under the back pole 56-*b*. These different pairs are arranged in an alternating manner.

In the pair formed by core 35 and back pole 56-*b* provided with the permanent magnet 34 under the back pole 56-*b*, leakage flux is large because the permanent magnet 34 is set apart from the end surface of the core 35, and hence magnetic attraction exerted on an armature 31 is comparatively small.

An armature yoke 51 is disposed in the periphery of the print head to enhance the magnetic flux that passes through the armature 31. The back pole 56-*b* induces the magnetic flux produced by the permanent magnet 34 to pass through the armature yoke 51 along a magnetic path 52. The back poles 56-*a* which define one magnetic path 46, and the back poles 56-*b* which define two magnetic paths 52 and 53 are arranged alternatingly, and the back poles 56-*b* are placed on the permanent magnet 34. As shown in FIGS. 10 and 13, the back poles 56-*b* include base portions, first upper branch portions extending substantially vertically from the base portions, and second upper branch portions extending radially outwardly and upwardly.

The armature yoke 51 is provided with projections 54 extending on the opposite sides of the armatures 31 to induce the magnetic flux to pass through the armatures 31 and the armature yoke 51. The projections 54 are formed only for the armatures 31 corresponding to the back poles 56-*b* placed on the permanent magnet 34, and no projection is formed for the armatures 31 corresponding to the cores 35 placed on the permanent magnet 34.

For the core/back pole pairs which include the back poles 56-*a*, the magnetic flux produced by the permanent magnet 34 is confined to a magnetic path as shown in FIG. 9, which, is similar to the magnetic path in the first embodiment of the wire dot print head. For the core/back pole pairs which include the back poles 56-*b*, the magnetic flux produced by the permanent magnet 34 is confined to the magnetic path 52 passing through the armature yoke 51 and the armature 31 as well as in the magnetic path 53 corresponding to that of the conventional wire dot print head, whereby the magnetic flux passing through the armature 31 is enhanced to enhance the magnetic attraction to be exerted on the armature 31.

In the foregoing embodiments, the plurality of cores are described as being arranged inside the plurality of back poles so as to be paired up with the back poles, but the cores could be arranged outside the arrangement of the back poles so as to be paired up with the back poles.

The wire dot print head in accordance with the present invention is suitable for application to information processing apparatus, particularly, to a printer for readily producing hard copies. The wire dot print head is particularly suitable for application to a serial printer which is expected to operate stably at a low power consumption rate.

We claim:

1. A wire dot print head comprising:

a frame;

a permanent magnet mounted on said frame;

a plurality of first core/back pole pairs, each of which comprises a first core mounted atop said permanent magnet and a first back pole not mounted atop said permanent magnet;

a plurality of second core-back pole pairs, each of which comprises a second back pole mounted atop said permanent magnet and a second core not mounted atop said permanent magnet, said plurality of first core/back pole pairs being respectively arranged, in an alternating manner with said plurality of second core/back pole pairs, in a circular arrangement;

a flat spring having a plurality of projections respectively extending in a cantilever manner over said plurality of first core/back pole pairs and said plurality of second core/back pole pairs;

a plurality of armatures respectively mounted to said plurality of projections of said flat spring;

a plurality of printing wires fixed respectively to extreme ends of said plurality of armatures;

wherein said permanent magnet comprises means for producing a first magnet flux to attract said plurality of armatures toward said plurality of first and second cores, respectively, against a resilience of said plurality of projections of said flat spring; and wherein coil means is provided for producing a second magnetic flux to selectively and respectively cancel the first magnetic flux and cause said plurality of armatures to selectively and respectively allow the resilience of said plurality of projections of said flat spring to force said plurality of armatures away from said plurality of first and second cores, respectively, said coil means comprising a plurality of coils respectively wound about said plurality of first and second cores.

2. A wire dot print head as recited in claim 1, wherein said first and second cores as disposed radially inwardly of said first and second back poles, respectively.

3. A wire dot print head as recited in claim 1, wherein said permanent magnet is formed as a plate having a plurality of radially outwardly projecting extensions and a plurality of radially inwardly extending recesses;

said first back poles are respectively mounted atop said extensions of said plate of said permanent magnet; and said second back poles are respectively mounted in said recesses of said plate of said permanent magnet.

4. A wire dot print head as recited in claim 3, wherein said plate which forms said permanent magnet further has a hole formed through a central portion thereof and extending radially outwardly to extend into each of said extensions of said plate of said permanent magnet; and said first cores are respectively mounted in said radially outwardly extending portions of said hole formed in said plate of said permanent magnet.

5. A wire dot print head as recited in claim 1, wherein said frame includes a circular base plate, an annular spacer ring mounted on said base plate, and a head frame mounted on said spacer ring; and said flat spring includes an annular portion which is mounted between said spacer ring and said head frame.

6. A wire dot print head as recited in claim 1, wherein said frame includes a circular base plate, an annular spacer ring mounted on said base plate along an outer peripheral edge thereof, and a head frame mounted on said spacer ring; and said first and second cores and said first and second back holes are mounted radially inwardly of said annular spacer ring.

7. A wire dot print head as recited in claim 1, wherein said permanent magnet is polarized throughout such that an upper portion thereof is of a first polarity and a lower portion thereof is of a second polarity opposite said first polarity.

8. A wire dot print head as recited in claim 1, wherein said frame includes a circular base plate, an annular spacer ring mounted on said base plate along an outer peripheral edge thereof, and a head frame mounted on said spacer ring; and said first and second cores and said first back poles are mounted radially inwardly of said annular spacer ring.

9. A wire dot print head as recited in claim 8, wherein each of said second back poles is formed with a base portion, a first upper branch portion extending substantially vertically from said base portion, and a second upper branch portion extending radially outwardly and upwardly; and each of said second back poles, together with said permanent magnet, one of said second cores and one of said armatures, defines two magnetic flux paths.

10. A wire dot print head as recited in claim 1, wherein each of said second back poles is formed with a base portion, a first upper branch portion extending substantially vertically from said base portion, and a second upper branch portion extending radially outwardly and upwardly; and each of said second back poles, together with said permanent magnet, one of said second cores and one of said armatures, defines two magnetic flux paths.

11. A wire dot print head as recited in claim 1, wherein said frame includes a circular base plate, an annular spacer ring mounted on said base plate along an outer peripheral edge thereof, and a head frame mounted on said spacer ring; and an annular armature yoke is interposed between said annular space ring and said head frame.

* * * * *